US011665490B2

(12) United States Patent
Gundlach et al.

(10) Patent No.: US 11,665,490 B2
(45) Date of Patent: May 30, 2023

(54) AUDITORY DEVICE CABLE ARRANGEMENT

(71) Applicants: Helen of Troy Limited, St. Michael (BB); NantSound Inc., Park Ridge, IL (US)

(72) Inventors: John D. Gundlach, Auburndale, MA (US); Stavros P. Basseas, Park Ridge, IL (US)

(73) Assignees: Helen of Troy Limited, St. Michael (BB); NantSound Inc., Park Ridge, IL (US)

( * ) Notice: Subject to any disclaimer, the term of this patent is extended or adjusted under 35 U.S.C. 154(b) by 0 days.

(21) Appl. No.: 17/166,022

(22) Filed: Feb. 3, 2021

(65) Prior Publication Data

US 2022/0248152 A1 Aug. 4, 2022

(51) Int. Cl.
*H04R 25/00* (2006.01)

(52) U.S. Cl.
CPC ..... *H04R 25/609* (2019.05); *H04R 25/652* (2013.01); *H04R 2225/0216* (2019.05); *H04R 2225/57* (2019.05)

(58) Field of Classification Search
CPC .... H04R 25/65; H04R 25/652; H04R 25/658; H04R 25/604; H04R 25/60; H04R 25/456; H04R 25/63; H04R 25/609; H04R 25/57; H04R 2225/61; H04R 2225/025; H04R 2225/021; H04R 2225/0216

(Continued)

(56) References Cited

U.S. PATENT DOCUMENTS 6,546,110 B1 4/2003 Vonlanthen
6,549,634 B1 4/2003 Vonlanthen (Continued)

FOREIGN PATENT DOCUMENTS

EP 3422739 1/2019
GB 792742 10/1956

(Continued)

OTHER PUBLICATIONS

US 9,668,071 B2, 05/2017, Pedersen et al. (withdrawn)
Israel Patent Office, International Search Report in PCT/US2022/013679, dated May 25, 2022, 6 pages.

*Primary Examiner* — Ahmad F. Matar
*Assistant Examiner* — Sabrina Diaz
(74) *Attorney, Agent, or Firm* — Rankin, Hill & Clark LLP

(57) ABSTRACT

An auditory device includes an electronics module, a receiver and a cable connecting the electronics module to the receiver. The electronics module includes an enclosure shaped to be positioned behind an outer portion of either a left ear or a right ear of a user and circuitry within the enclosure. The receiver is configured for being located in either a left or a right ear canal of the user. When inserted into the left ear canal, the receiver occupies a left ear canal insertion position, and when inserted into the right ear canal, the receiver occupies a right ear canal insertion position. The cable and the receiver are shaped and configured such that the receiver is presented in a neutral position when no external force other than gravity is acting upon the receiver, the neutral position being between the left ear canal insertion position and the right ear canal insertion position.

18 Claims, 3 Drawing Sheets

(58) Field of Classification Search
USPC ..... 381/322, 324, 328, 330
See application file for complete search history.

(56) References Cited

U.S. PATENT DOCUMENTS

| | | | | |
|---|---|---|---|---|
| 6,831,988 | B2 | 12/2004 | Vonlanthen | |
| 6,850,775 | B1 | 12/2005 | Berg | |
| 6,978,155 | B2 | 12/2005 | Berg | |
| 7,016,512 | B1 | 3/2006 | Feeley | |
| 7,024,000 | B1 | 4/2006 | Gabara | |
| 7,110,562 | B1 | 9/2006 | Feeley | |
| 7,139,404 | B2 | 11/2006 | Feeley | |
| 7,283,842 | B2 | 10/2007 | Berg | |
| 7,570,777 | B1 | 8/2009 | Taenzer | |
| 7,606,382 | B2 | 10/2009 | Feeley | |
| 7,715,582 | B2 | 5/2010 | Ochsenbein | |
| 7,925,038 | B2 | 4/2011 | Taenzer | |
| 8,050,437 | B2 | 11/2011 | Feeley | |
| 8,094,850 | B2 | 1/2012 | Feeley | |
| 8,121,320 | B2 | 2/2012 | Sjursen | |
| 8,379,871 | B2 | 2/2013 | Michael | |
| 8,462,972 | B2 | 6/2013 | Hastrup | |
| 8,503,703 | B2 | 8/2013 | Eaton | |
| 8,644,543 | B2 | 2/2014 | Lederer | |
| 8,675,900 | B2 | 3/2014 | Anderson | |
| 8,781,141 | B2 | 7/2014 | Higgins | |
| 8,958,590 | B2 | 2/2015 | Hastrup | |
| 8,965,016 | B1 | 2/2015 | Howes | |
| 9,107,016 | B2 | 2/2015 | Shennib | |
| 8,965,017 | B2 | 3/2015 | Bryant | |
| 8,971,556 | B2 | 3/2015 | Fleizach | |
| 8,976,991 | B2 | 3/2015 | Feeley | |
| 9,014,405 | B2 | 4/2015 | Larsen | |
| 9,197,971 | B2 | 11/2015 | Michael | |
| 9,204,228 | B2 | 12/2015 | Chan | |
| 9,253,583 | B2 | 2/2016 | Blamey | |
| 9,326,706 | B2 | 5/2016 | Shennib | |
| 9,357,317 | B2 | 5/2016 | Eaton | |
| 9,374,649 | B2 | 6/2016 | Krystek | |
| 9,380,394 | B2 | 6/2016 | Krystek | |
| 9,439,006 | B2 | 9/2016 | Sacha | |
| 9,439,008 | B2 | 9/2016 | Shennib | |
| 9,468,401 | B2 | 10/2016 | Van Hasselt | |
| 9,473,858 | B2 | 10/2016 | Pedersen | |
| 9,485,592 | B2 | 11/2016 | Riepenhoff | |
| 9,516,438 | B2 | 12/2016 | Andersen | |
| 9,516,439 | B2 | 12/2016 | Westergaard | |
| 9,532,152 | B2 | 12/2016 | Shennib | |
| 9,532,154 | B2 | 12/2016 | Bang | |
| 9,538,298 | B2 | 1/2017 | Wu | |
| 9,553,984 | B2 | 1/2017 | Krause | |
| 9,571,940 | B2 | 2/2017 | Sommer | |
| 9,571,945 | B2 | 2/2017 | Yun | |
| 9,591,393 | B2 | 3/2017 | Feeley | |
| 9,609,441 | B2 | 3/2017 | Krystek | |
| 9,609,442 | B2 | 3/2017 | Krystek | |
| 9,621,999 | B2 | 4/2017 | Sudan | |
| 9,723,417 | B2 | 8/2017 | Choi | |
| 2003/0002700 | A1* | 1/2003 | Fretz | H04R 25/65 381/330 |
| 2007/0014423 | A1 | 6/2007 | Darbut | |
| 2010/0232612 | A1 | 9/2010 | Basseas | |
| 2011/0188690 | A1 | 8/2011 | Larsen | |
| 2012/0014547 | A1* | 1/2012 | Sjursen | H04R 25/602 381/323 |
| 2013/0266164 | A1 | 10/2013 | Woods | |
| 2014/0328492 | A1 | 11/2014 | Feeley | |
| 2016/0134960 | A1 | 5/2016 | Den Hartog | |
| 2016/0142836 | A1 | 5/2016 | DuBrino et al. | |
| 2016/0165367 | A1 | 6/2016 | Ochsenbein | |
| 2016/0308386 | A1 | 10/2016 | Tang | |
| 2016/0381472 | A1 | 12/2016 | Feeley | |
| 2017/0070833 | A1 | 3/2017 | Shennib | |
| 2017/0094425 | A1 | 3/2017 | Baeriswyl | |
| 2017/0164120 | A1 | 6/2017 | Johansen | |
| 2019/0079580 | A1 | 3/2019 | Ura | |
| 2019/0208332 | A1* | 7/2019 | Higgins | H04R 25/02 |
| 2020/0143703 | A1 | 5/2020 | Fabry | |
| 2020/0162828 | A1 | 5/2020 | Higgins | |

FOREIGN PATENT DOCUMENTS

| | | | |
|---|---|---|---|
| WO | 2016/055109 | 2/2016 | |
| WO | 2017/084686 | 5/2017 | |
| WO | WO-2021207190 A1 * | 10/2021 | H04R 25/00 |

* cited by examiner

AUDITORY DEVICE CABLE ARRANGEMENT

BACKGROUND

A hearing aid having a receiver (speaker) that is connected via wires to an electronics module is known as a receiver-in-canal (RIC) type hearing aid. The wires of RIC type hearing aids are typically disposed in tubing or a jacket to form a cable. It is desirable that the cable be inconspicuous when the RIC type hearing aid is in use.

When fitting conventional RIC type hearing aids, one determines the particular ear, left or right, of the user with which the RIC type hearing aid will be used. Typically two different RIC type hearing aids are provided to an individual who needs hearing aids for both ears. Also, the length of the cable connecting the electronics module with the receiver is not self-adjustable. Instead, many different lengths of cables are available, and a cable of a particular length is provided for each ear based on measurements taken by the individual or a hearing specialist. This requires RIC type hearing aid to manufacture different electronics module, e.g., an electronics module for the left ear and an electronics module for the right ear, and it also requires RIC type hearing aid to manufacture cables of differing lengths.

SUMMARY

In view of the foregoing, an auditory device includes an electronics module, a receiver and a cable connecting the electronics module to the receiver. The electronics module includes an enclosure shaped to be positioned behind an outer portion of either a left ear or a right ear of a user and circuitry within the enclosure. The receiver is configured for being located in either a left ear canal or a right ear canal of the user. When inserted into the left ear canal, the receiver occupies a left ear canal insertion position, and when inserted into the right ear canal, the receiver occupies a right ear canal insertion position. The cable and the receiver are shaped and configured such that the receiver is presented in a neutral position when no external force other than gravity is acting upon the receiver, the neutral position being located between the left ear canal insertion position and the right ear canal insertion position.

DETAILED DESCRIPTION

Figure 1:
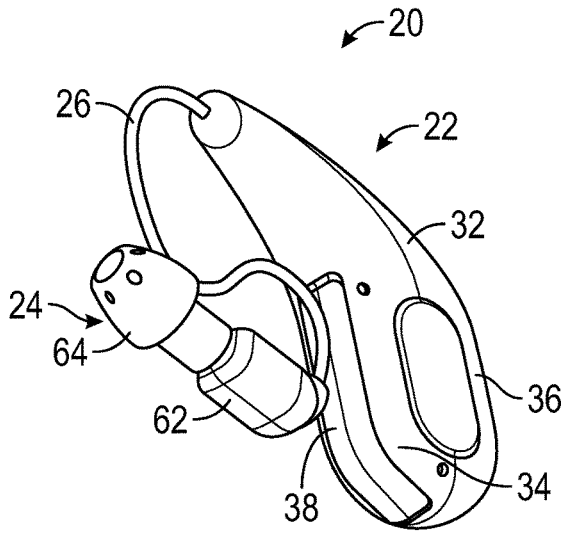
FIG. 1 is a front perspective view of an auditory device.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIG. 1 depicts an auditory device 20, which can be in the form of an RIC type hearing aid, including an electronics module 22, a receiver 24 and a cable 26 connecting the electronics module 22 to the receiver 24. Unlike conventional RIC type hearing aids, the auditory device 20 can fit with both a left ear and a right ear of the user so that two identically constructed auditory devices 20 can be provided to one individual for use in either ear. Also, the cable 26 connecting the electronics module 22 to the receiver 24 is advantageously constructed to accommodate a large range of ear sizes instead of providing one particular length cable for each different ear size as is done with conventional RIC type hearing aids.

The electronics module 22 includes an enclosure 32 that is shaped to be positioned behind an outer portion of either the left ear or the right ear of a user. In general, the enclosure 32 is made from a rigid plastic material and made up of an anterior section 34 connected with a posterior section 36. A battery door 38 pivotally connects with the anterior section 34 to provide access to a battery compartment that can house a battery which can operate as a power source for the auditory device 20.

Figure 2:
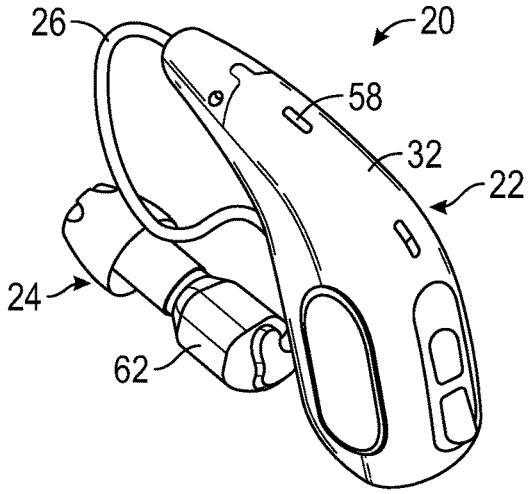
FIG. 2 is a rear perspective view of the auditory device.
Figure 3:
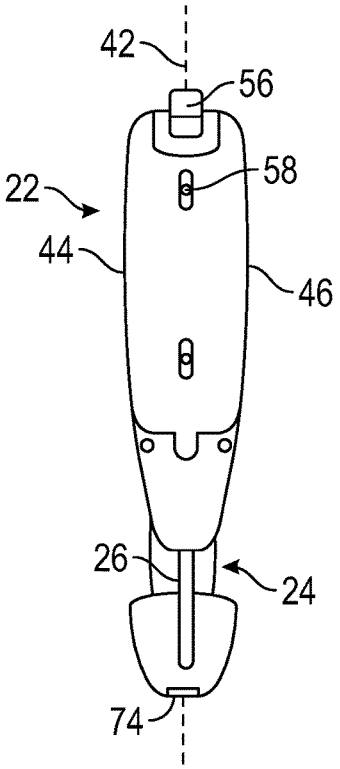
FIG. 3 is a top plan view of the auditory device.
Figure 4:
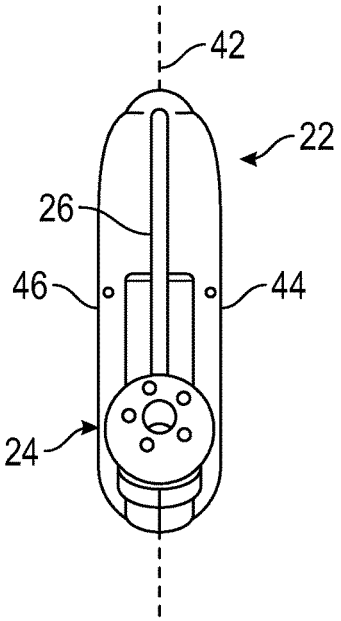
FIG. 4 is a front elevation view of the auditory device.
Figure 5:
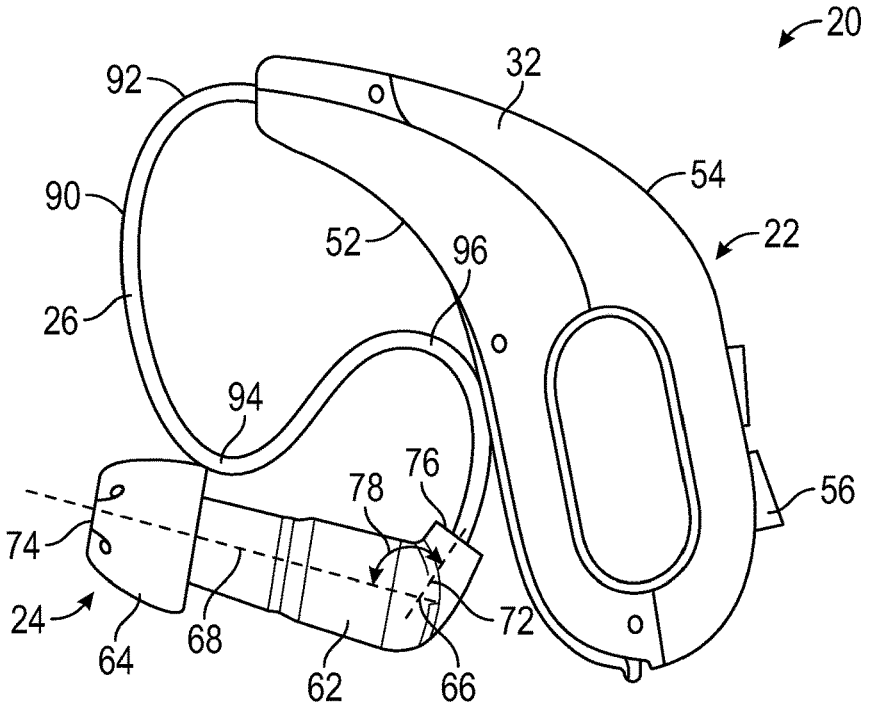
FIG. 5 is a left side elevation view of the auditory device.

With reference to FIGS. 3 and 4, the enclosure 32 is symmetrical with respect to a symmetrical plane 42. The enclosure 32 can include a left side surface 44 and a right side surface 46 that are generally planar while tapering slightly toward the symmetrical plane 42 near where the cable 26 extends from the enclosure 32. With reference to FIG. 5, the enclosure 32 can include an anterior surface 52 that connects the left side surface 44 and the right side surface 46, and a posterior surface 54 that connects the left side surface 44 and the right side surface 46. The anterior surface 52 is curved more noticeably from a free end of the battery door 38 moving in the direction toward where the cable 26 extends from the enclosure 32. The posterior surface 54 is also curved more noticeably near where the cable 26 extends from the enclosure 32. Control buttons 56 can also be provided extending from or on the enclosure 32 to control operations of the auditory device 20 such as volume and the like. With reference back to FIGS. 2 and 3, openings 58 can also be provided on the enclosure 32 to provide access to microphones, which will be described in more detail below.

The electronics module 22 can be similar to known electronics modules with regard to the components provided within the enclosure 32. In view of this, these components will not be described with particularity with the understanding that one of ordinary skill in the art would understand how to make and use these components. Similar to known RIC type hearing aids, the electronics module 22 can include circuitry and an appropriate processing unit for controlling different programs, between which the processing unit can switch and includes reception of a telecoil signal. The processing unit can also be used for controlling sound processing, noise reduction etc. The electronics module 22 can further include a radio module, which allows for TV and other audio streaming. Microphones, which can allow for the use of a directional system, can also be provided with the electronics module 22. The electronics module 22 can further house a battery, which is accessible through the battery door 38, and a charging coil. The battery may be a rechargeable battery, a zinc-silver battery or a lithium-polymer battery. Depending on the type of battery provided, a power management circuit may also be provided with the electronics module 22 to control and monitor the charging and discharging of the battery, if it is a rechargeable battery.

The receiver 24 is configured for being located in either the left ear canal or the right ear canal of the user. The receiver 24 includes a housing 62 made from a rigid plastic material, and the housing 62 connects with an ear bud 64 that is also shaped to fit in either the left ear canal or the right ear canal of the user. The housing 62 houses electrical components that are similar to known receivers in RIC type hearing aids, which will not be described in detail for the sake of brevity. With reference to FIG. 5, the housing 62 is provided with an elbow 66 as seen when viewing a first axis 68 intersecting with a second axis 72 where both axes reside in the symmetrical plane 42 (see FIGS. 3 and 4). The first axis 68 extends from the center of an ear bud outlet 74 (FIG. 3) to the elbow 66 and the second axis 72 extends from the elbow 66 to the center of the opening 76 in the housing 62 that receives the cable 26. The angle 78 at the elbow 66 between the first axis 68 and the second axis 72 is an obtuse angle, which can measure about 100 degrees, e.g., between 95 degrees and 105 degrees. This angle 78 helps align the receiver 24 in either the left ear canal or the right ear canal of the user.

The cable 26 includes a plurality of wires (not visible) provided within a jacket 90. The wires can be stranded metal wires to provide for the electrical connection between the electronics module 22 and the receiver 24. The jacket 90 is made from a flexible material, and the wires and the jacket 90 are formed in a manner so that the cable 26 can be set, e.g. thermoset, into the shape shown in FIG. 1 when no external force other than gravity is acting upon the receiver 24. The cable 26 is configured to be extended a predetermined amount (see FIG. 6) and twisted (see FIG. 7) while being capable of returning to the position shown in FIGS. 1-5 when no external force other than gravity is acting upon the receiver 24.

Figure 7:
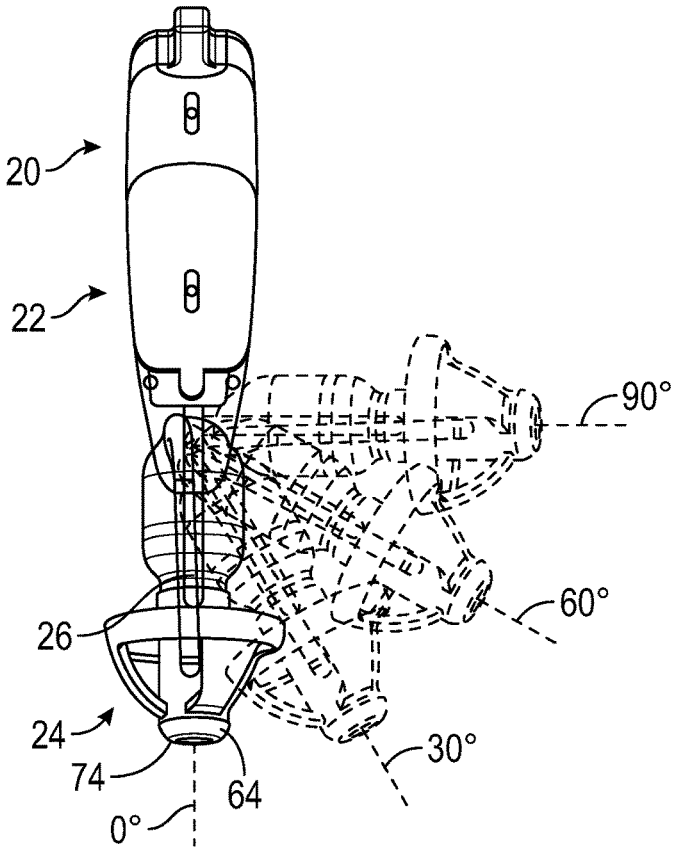
FIG. 7 is a top plan view of the auditory device showing the cable twisted into different positions.
Figure 8:
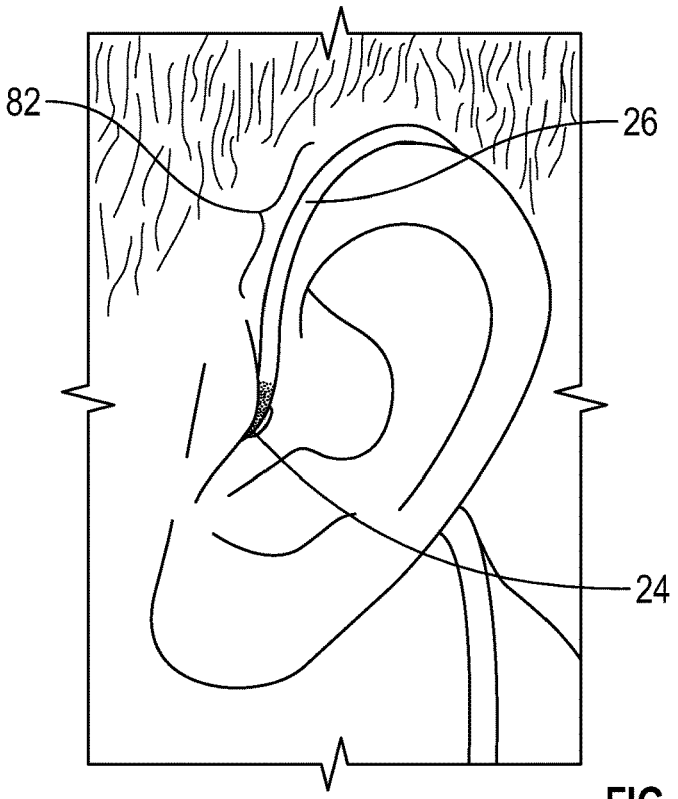
FIG. 8 is a perspective view of the auditory device with a receiver received in the left ear canal of a user.

The cable 26 is formed and set so that the receiver 24 can be located in either a left ear canal or a right ear canal of the user. With reference to FIG. 8, when inserted into the left ear canal, the receiver 24 occupies a left ear canal insertion position. The cable 26 can also be twisted, which would typically be between the 60 degree and the 90 degree position in FIG. 7 so that when inserted into the right ear canal, the receiver occupies a right ear canal insertion position. The cable 26 is also formed and set so that the receiver 24 occupies a neutral position, which is between the left ear canal insertion position and the right ear canal insertion position, when no external force other than gravity is acting upon the receiver, which is shown in FIGS. 1-5. In a more particular example, such as that shown in FIGS. 1-5, when the receiver 24 occupies the neutral position the ear bud outlet 74 is positioned in the symmetrical plane 42. This is also shown in FIG. 7, which shows the ear bud 64 in an alternative configuration and the neutral position as the 0 degree position. When the receiver 24 occupies the neutral position, the ear bud outlet 74 is also facing away from the electronics module 22. This orientation of the receiver 24 reduces the rotation from the neutral position toward the left ear canal insertion position or the right ear canal insertion position that is below 90 degrees. If the receiver 24 was oriented in the opposite direction, i.e., pointing towards the electronics module 22, more rotation would be needed, which would likely require more torque to rotate the receiver 24.

The cable 26 is formed and set so that when the receiver 24 is inserted into either the left ear canal or the right ear canal, the force exerted by the cable 26 on the ear cavity is minimized to reduce pressure on the ear cavity that could cause pain over long periods of wear. For example and with reference to FIG. 7, a torque required to rotate the receiver 24 from the neutral position 90 degrees toward the left ear canal insertion position and from the neutral position 90 degrees toward the right ear canal insertion position is less than 0.00045 Nm. Also, the torque required to rotate the receiver 24 from the neutral position 60 degrees toward the left ear canal insertion position and from the neutral position 60 degrees toward the right ear canal insertion position can be less than 0.0003 Nm. Accordingly, with such small forces required to twist the receiver 24 into either the left ear canal or the right ear canal of the user, the force exerted by the cable 26 on the ear cavity of the user is greatly lessened.

With reference to FIG. 8, the cable 26 is formed and set so that at least an upper portion 82 the cable 26 is biased toward the user's head or the ear cavity of the left ear of the user when the electronics module 22 is positioned behind the outer portion of left ear of the user and the cable is twisted from the receiver being in the neutral position toward the receiver being located in the left ear canal in the left ear canal insertion position. The cable 26 is also formed and set so that the upper portion 82 of the cable 26 is biased toward the user's head or the ear cavity of the right ear of the user when the electronics module 22 is positioned behind the outer portion of right ear of the user and the cable 26 is twisted from the receiver 24 being in the neutral position toward the receiver 24 being located in the left ear canal in the left ear canal insertion position. Accordingly, the bias of the cable 26 keeps the cable located near the user's head or ear cavity, which provides a discreet and inconspicuous cable 26 connecting the electronics module 22 with the receiver 24. Once the receiver 24 is inserted in the canal insertion position the cable 26 self-adjusts to the height of the user ear.

Figure 6:
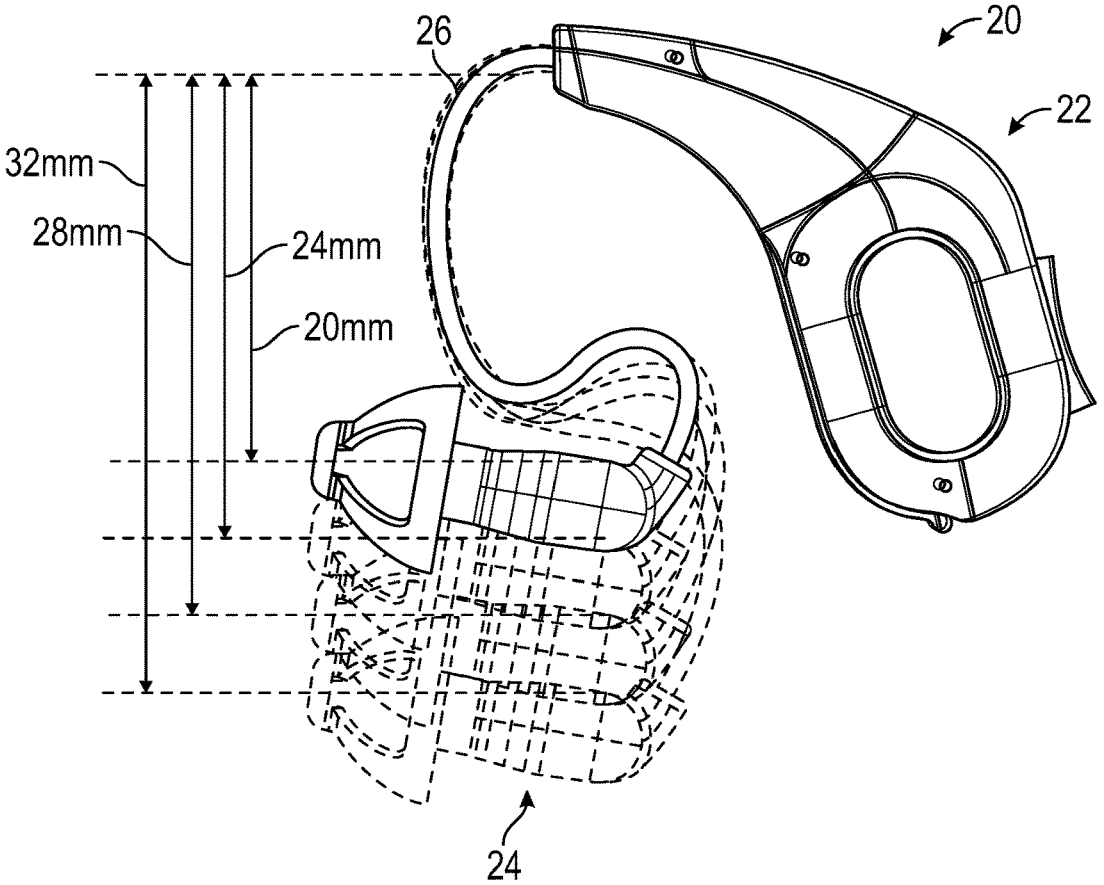
FIG. 6 is another left side view of the auditory device showing a cable extended into different positions.

The cable 26 is also formed and set so that the auditory device 20 is capable of accommodating a large range of ear sizes. Instead of exchanging out the cable to accommodate different ear sizes, the cable 26 can extend from the neutral position at least 12 mm downward by pulling on the receiver 24, which is shown in FIG. 6, while still being able to be twisted so that the receiver 24 can occupy either the left ear canal insertion position or the right ear canal insertion position. The cable 26 is also formed and set so that the force required to extend the cable 26 to change the location of the receiver 24 with respect to where the cable 26 extends form the enclosure 32 is very small. For example, an expansion force required to extend the receiver 24 at least 12 mm downward from the neutral position is less than 100 milliNewtowns (mN). Such a small force required to extend the cable 26 also exerts very little pressure on the ear canal when the receiver 24 is received inside the ear canal.

With reference to FIG. 5, the cable 26 follows a curve along the symmetrical plane 42 (see FIGS. 3 and 4) that includes a first turning point 92, a second turning point 94 and a third turning point 96 when the receiver 24 is presented in the neutral position with no external force other than gravity acting upon the receiver 24. The cable 26 is formed and set, e.g., thermoset, to follow this curve, which can be in the form of an "S" and allows for the auditory device 20 to fit a number of different ear sizes and allows the auditory device 20 to work with both the left and right ear. When travelling along the cable 26 from where the cable 26 extends from the enclosure 32 of the electronics module 22 toward the where the cable 26 connects with the receiver 24, the first turning point 92 is located nearest to where the cable 26 extends from the enclosure 32, the second turning point 94 is located between the first turning point 92 and the third turning point 96, and the third turning point 96 is located nearest to the receiver 24. The second turning point 94 is located vertically below the third turning point 96 when the electronics module 22 is positioned in the manner shown in FIG. 5 and the receiver 24 is in the neutral position with no external force other than gravity acting upon the receiver 24. The cable 26 is formed and set such that the second turning point 94 remains located vertically below the third turning point 96 when the electronics module 22 is rotated in the symmetrical plane 42 in which the curve of the cable 26 resides and the receiver 24 is presented in a neutral position with no external force other than gravity acting upon the receiver 24. This can be seen when comparing FIG. 5 to FIG. 6. The electronics module 22 in FIG. 6 has been rotated slightly counterclockwise from the position shown in FIG. 5. As such, when the electronics module 22 is positioned to be behind the outer portion of either the left ear or the right ear of the user and the receiver 24 is in the neutral position with no external force other than gravity acting upon the receiver 24, the second turning point 94 remains located vertically below the third turning point 96. Such a shape for the cable 26 can allow for the desired extension of the cable 26 to accommodate different ear sizes, which can be seen from FIG. 6.

An auditory device has been described above with particularity. Modifications and alterations may occur to those skilled in the art after having read the above detailed description. The invention, however, is not limited to only the embodiments described above. Instead, the invention is broadly defined by the appended claims and the equivalents thereof. It will be appreciated that variations of the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An auditory device comprising:

an electronics module including an enclosure shaped to be positioned behind an outer portion of either a left ear or a right ear of a user and circuitry within the enclosure;

a receiver configured for being located in either a left ear canal or a right ear canal of the user, when inserted into the left ear canal the receiver occupying a left ear canal insertion position, and when inserted into the right ear canal the receiver occupying a right ear canal insertion position; and a cable connecting the electronics module to the receiver, the cable including wires provided within a jacket made from a flexible material, the cable and the receiver being shaped and configured such that the receiver is presented in a neutral position when no external force other than gravity is acting upon the receiver, the neutral position being located between the left ear canal insertion position and the right ear canal insertion position, wherein the cable follows a curve that includes a first turning point, a second turning point, and a third turning point when the receiver is presented in the neutral position with no external force other than gravity acting upon the receiver, when travelling along the cable from where the cable extends from the enclosure of the electronics module toward where the cable connects with the receiver the first turning point being located nearest to where the cable extends from the enclosure of the electronics module, the second turning point being located between the first turning point and the third turning point, and the third turning point being located nearest to the receiver, wherein the second turning point is located vertically below the third turning point when the electronics module is positioned so as to be positioned behind the outer portion of either the left ear or the right ear of the user and the receiver is in the neutral position with no external force other than gravity acting upon the receiver, wherein an expansion force required to extend the receiver at least 12 mm downward from the neutral position is less than 100 milliNewtons (mN).

2. The auditory device of claim 1, wherein at least an upper portion of the cable is configured so as to be biased toward the user's head or the ear cavity of the left ear of the user when the electronics module is positioned behind the outer portion of left ear of the user and the cable is twisted from the receiver being in the neutral position toward the receiver being located in the left ear canal in the left ear canal insertion position, and the upper portion of the cable is configured so as to be biased toward the user's head or the ear cavity of the right ear of the user when the electronics module is positioned behind the outer portion of right ear of the user and the cable is twisted from the receiver being in the neutral position toward the receiver being located in the right ear canal in the right ear canal insertion position.

3. The auditory device of claim 1, wherein the cable is formed such that the second turning point remains located vertically below the third turning point when the electronics module is rotated in a plane in which the curve resides and the receiver is presented in the neutral position with no external force other than gravity acting upon the receiver.

4. The auditory device of claim 1, wherein the enclosure is symmetrical with respect to a symmetrical plane.

5. The auditory device of claim 4, wherein the receiver includes a housing and an ear bud connected with the housing, wherein the ear bud includes an ear bud outlet positioned in the symmetrical plane when the receiver is presented in the neutral position with no external force other than gravity acting upon the receiver.

6. The auditory device of claim 5, wherein the ear bud outlet faces away from the electronics module when the receiver is in the neutral position with no external force other than gravity acting upon the receiver.

7. The auditory device of claim 1, wherein the receiver includes a housing and an ear bud connected with the housing, wherein the ear bud includes an ear bud outlet facing away from the electronics module when the receiver is in the neutral position with no external force other than gravity acting upon the receiver.

8. The auditory device of claim 1, wherein the receiver includes a housing and an ear bud connected with the housing, the housing including an elbow.

9. The auditory device of claim 8, wherein the elbow is located at an intersection of a first axis extending through a center of an ear bud outlet of the ear bud and a second axis extending through a center of an opening in the housing that receives the cable.

10. The auditory device of claim 9, wherein an angle measured between the first axis and the second axis is an obtuse angle.

11. The auditory device of claim 10, wherein the angle measured between the first axis and the second axis is between 95 degrees and 105 degrees.

12. An auditory device comprising:

an electronics module including an enclosure shaped to be positioned behind an outer portion of either a left ear or a right ear of a user and circuitry within the enclosure;

a receiver configured for being located in either a left ear canal or a right ear canal of the user, when inserted into the left ear canal the receiver occupying a left ear canal insertion position, and when inserted into the right ear canal the receiver occupying a right ear canal insertion position; and a cable connecting the electronics module to the receiver, the cable including wires provided within a jacket made from a flexible material, the cable and the receiver being shaped and configured such that the receiver is presented in a neutral position when no external force other than gravity is acting upon the receiver, the neutral position being located between the left ear canal insertion position and the right ear canal insertion position, wherein the cable follows a curve that includes a first turning point, a second turning point, and a third turning point when the receiver is presented in the neutral position with no external force other than gravity acting upon the receiver, when travelling along the cable from where the cable extends from the enclosure of the electronics module toward where the cable connects with the receiver the first turning point being located nearest to where the cable extends from the enclosure of the electronics module, the second turning point being located between the first turning point and the third turning point, and the third turning point being located nearest to the receiver, wherein the second turning point is located vertically below the third turning point when the electronics module is positioned so as to be positioned behind the outer portion of either the left ear or the right ear of the user and the receiver is in the neutral position with no external force other than gravity acting upon the receiver, wherein a torque required to rotate the receiver from the neutral position 90 degrees toward the left ear canal insertion position and from the neutral position 90 degrees toward the right ear canal insertion position is less than 0.00045 Nm.

13. The auditory device of claim 12, wherein a torque required to rotate the receiver from the neutral position 60 degrees toward the left ear canal insertion position and from the neutral position 60 degrees toward the right ear canal insertion position is less than 0.0003 Nm.

14. The auditory device of claim 12, wherein an expansion force required to extend the receiver at least 12 mm downward from the neutral position is less than 100 milliNewtons (mN).

15. The auditory device of claim 12, wherein at least an upper portion of the cable is configured so as to be biased toward the user's head or the ear cavity of the left ear of the user when the electronics module is positioned behind the outer portion of left ear of the user and the cable is twisted from the receiver being in the neutral position toward the receiver being located in the left ear canal in the left ear canal insertion position, and the upper portion of the cable is configured so as to be biased toward the user's head or the ear cavity of the right ear of the user when the electronics module is positioned behind the outer portion of right ear of the user and the cable is twisted from the receiver being in the neutral position toward the receiver being located in the right ear canal in the right ear canal insertion position.

16. The auditory device of claim 12, wherein the cable is formed such that the second turning point remains located vertically below the third turning point when the electronics module is rotated in a plane in which the curve resides and the receiver is presented in the neutral position with no external force other than gravity acting upon the receiver.

17. The auditory device of claim 12, wherein the enclosure is symmetrical with respect to a symmetrical plane, wherein the receiver includes a housing and an ear bud connected with the housing, wherein the ear bud includes an ear bud outlet positioned in the symmetrical plane when the receiver is presented in the neutral position with no external force other than gravity acting upon the receiver, and wherein the ear bud outlet faces away from the electronics module when the receiver is in the neutral position with no external force other than gravity acting upon the receiver.

18. The auditory device of claim 12, wherein the receiver includes a housing and an ear bud connected with the housing, the housing including an elbow, wherein the elbow is located at an intersection of a first axis extending through a center of an ear bud outlet of the ear bud and a second axis extending through a center of an opening in the housing that receives the cable, wherein an angle measured between the first axis and the second axis is an obtuse angle, and wherein the angle measured between the first axis and the second axis is between 95 degrees and 105 degrees.

* * * * *